US010309191B2

(12) United States Patent
Leuchtenberg

(10) Patent No.: US 10,309,191 B2
(45) Date of Patent: Jun. 4, 2019

(54) METHOD OF AND APPARATUS FOR DRILLING A SUBTERRANEAN WELLBORE

(71) Applicant: MANAGED PRESSURE OPERATIONS PTE. LTD., Singapore (SG)

(72) Inventor: Christian Leuchtenberg, Singapore (SG)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 454 days.

(21) Appl. No.: 14/384,619

(22) PCT Filed: Mar. 12, 2013

(86) PCT No.: PCT/EP2013/054999

§ 371 (c)(1),
(2) Date: Sep. 11, 2014

(87) PCT Pub. No.: WO2013/135694

PCT Pub. Date: Sep. 19, 2013

(65) Prior Publication Data

US 2015/0034384 A1 Feb. 5, 2015

Related U.S. Application Data

(63) Continuation-in-part of application No. 13/443,332, filed on Apr. 10, 2012, now Pat. No. 9,004,178.

(30) Foreign Application Priority Data

| | | |
|---|---|---|
| Mar. 12, 2012 | (GB) | 1204310.5 |
| Apr. 11, 2012 | (GB) | 1206405.1 |
| Jul. 27, 2012 | (SG) | 201205633 |

(51) Int. Cl.
*E21B 19/09* (2006.01)
*E21B 7/128* (2006.01)
(Continued)

(52) U.S. Cl.
CPC ..... *E21B 34/04* (2013.01); *E21B 33/064* (2013.01)

(58) Field of Classification Search
None
See application file for complete search history.

(56) References Cited

U.S. PATENT DOCUMENTS

| | | | |
|---|---|---|---|
| 2,609,836 | A | 9/1952 | Knox |
| 2,731,281 | A | 1/1956 | Knox |

(Continued)

FOREIGN PATENT DOCUMENTS

| | | | |
|---|---|---|---|
| EP | 1 659 260 | A2 | 5/2006 |
| EP | 2 378 056 | A2 | 10/2011 |

(Continued)

OTHER PUBLICATIONS

U.S. Appl. No. 14/394,038, filed Oct. 10, 2014.

*Primary Examiner* — Matthew R Buck
*Assistant Examiner* — Douglas S Wood
(74) *Attorney, Agent, or Firm* — Norman B. Thot

(57) ABSTRACT

A method of drilling a subterranean well bore comprising, monitoring the well bore for influx of formation fluid into the well bore, and, on detection of an influx, a) stopping any pump pumping fluid into the well bore, b) operating a first blow out preventer so that it closes within a first period of time, c) operating a second blow out preventer so that it closes within a second period of time, the second blow out preventer being located below the first blow out preventer, the second period of time being longer than the first period of time, d) circulating the influx out of the well bore via a (Continued)

flow line extending from below the second blow out preventer.

16 Claims, 13 Drawing Sheets

(51) Int. Cl.
*E21B 21/14* (2006.01)
*E21B 34/04* (2006.01)
*E21B 33/064* (2006.01)

(56) References Cited

U.S. PATENT DOCUMENTS 3,044,481 A 7/1962 Regan
3,128,077 A 4/1964 Lucky
3,225,831 A 12/1965 Knox
3,299,957 A 1/1967 O'Neill et al.
3,323,773 A 6/1967 Walker
3,561,723 A 2/1971 Cugini
3,651,823 A 3/1972 Milsted, Sr.
3,667,721 A 6/1972 Vujasinovic
3,695,349 A 10/1972 Murman et al.
3,942,824 A 3/1976 Sable
4,046,191 A 9/1977 Neath
4,095,421 A 6/1978 Silcox
4,097,253 A 6/1978 Phillips et al.
4,098,341 A 7/1978 Lewis
4,317,557 A 3/1982 Orr
4,484,785 A 11/1984 Jackson
4,509,405 A 4/1985 Bates
4,614,148 A 9/1986 Bates
4,615,543 A 10/1986 Cannon
4,626,135 A * 12/1986 Roche ..... E21B 21/001 166/84.4
4,832,126 A * 5/1989 Roche ..... E21B 21/001 137/114
4,844,179 A 7/1989 Forrest et al.
4,858,882 A 8/1989 Beard et al.
4,923,008 A 5/1990 Wachowicz et al.
5,803,193 A 9/1998 Krueger et al.
6,192,680 B1 2/2001 Brugman et al.
6,349,779 B1 2/2002 Gilbert
6,474,422 B2 * 11/2002 Schubert ..... E21B 21/001 175/25
6,655,405 B2 * 12/2003 Hollister ..... E21B 34/02 137/102
6,913,092 B2 * 7/2005 Bourgoyne ..... E21B 21/001 175/195
7,357,145 B2 4/2008 Soderberg
7,575,073 B2 8/2009 Swartout
7,997,345 B2 * 8/2011 Hannegan ..... E21B 33/085 166/345
8,033,335 B2 * 10/2011 Orbell ..... E21B 17/085 166/268
8,347,982 B2 * 1/2013 Hannegan ..... E21B 19/09 166/347
8,579,033 B1 * 11/2013 Robichaux ..... E21B 33/06 166/339
8,776,894 B2 7/2014 Orbell et al.
2002/0100589 A1 8/2002 Childers et al.
2003/0136587 A1 7/2003 Boulet
2004/0195009 A1 10/2004 Boulet
2008/0185046 A1 8/2008 Springett et al.
2008/0267786 A1 10/2008 Springett et al.
2010/0084588 A1 4/2010 Curtiss, III et al.
2010/0326738 A1 12/2010 Boulet
2011/0005770 A1 1/2011 Scranton et al.
2011/0088913 A1 4/2011 Baugh
2011/0100637 A1 5/2011 Gustafson
2011/0131964 A1 6/2011 Kocurek et al.
2011/0284236 A1 11/2011 Baugh
2012/0111572 A1 5/2012 Cargol, Jr.
2012/0227978 A1 9/2012 Fossli et al.
2013/0233562 A1 9/2013 Leuchtenberg

FOREIGN PATENT DOCUMENTS

FR 2789438 A1 8/2000
FR 2835014 A1 7/2003
FR 2851608 A1 8/2004
FR 2927937 A1 8/2009
GB 326615 A 3/1930
GB 471732 A 9/1937
GB 471794 A 9/1937
GB 474499 A 11/1937
GB 627196 A 8/1949
GB 1248499 A 10/1971
GB 1 294 288 A 10/1972
GB 2489265 A 9/2012
GB 2500188 A 9/2013
RU 2 198 282 C2 5/2002
WO WO 02/088516 A1 11/2002
WO WO 03/023181 A1 3/2003
WO WO 2005/093204 A1 10/2005
WO WO 2009/123476 A1 10/2009
WO WO 2009/132300 A2 10/2009
WO WO 2011/058031 A2 5/2011
WO WO 2011/128690 A1 10/2011
WO WO 2011/149806 A2 12/2011
WO WO 2012/127180 A2 9/2012
WO WO 2012/127227 A2 9/2012

* cited by examiner

METHOD OF AND APPARATUS FOR DRILLING A SUBTERRANEAN WELLBORE

The present invention relates to a drilling system and a method of operating a drilling system in particular for the drilling of a subterranean well bore for oil and/or gas production.

Subterranean drilling typically involves rotating a drill bit from surface or on a downhole motor at the remote end of a tubular drill string. It involves pumping a fluid down the inside of the tubular drillstring, through the drill bit, and circulating this fluid continuously back to surface via the drilled space between the hole/tubular, referred to as the annulus. This pumping mechanism is provided by positive displacement pumps that are connected to a manifold which connects to the drillstring, and the rate of flow into the drillstring depends on the speed of these pumps. The drillstring is comprised of sections of tubular joints connected end to end, and their respective outside diameter depends on the geometry of the hole being drilled and their effect on the fluid hydraulics in the wellbore.

Mud is pumped down the drill string utilizing the mud pumps which circulates through the drill bit, and returns to the surface via the annular space between the outer diameter of the drill string and the wellbore (generally referred to as the annulus). For a subsea well bore, a tubular, known as a riser extends from the rig to the top of the wellbore which exists at subsea level on the ocean floor. It provides a continuous pathway for the drill string and the fluids emanating from the well bore. In effect, the riser extends the wellbore from the sea bed to the rig, and the annulus also comprises the annular space between the outer diameter of the drill string and the riser.

The entire drillstring and bit may be rotated using a rotary table or using an above ground motor mounted on the top of the drill pipe known as a top drive. The bit can also be turned independently of the drillstring by a drilling fluid powered downhole motor, integrated into the drillstring just above the bit. Bit types vary and have different designs in their profile in regards to items such as cutter design and profile, and their selection is based on the formation type being drilled.

As drilling progresses, pipe has to be connected to the existing drillstring to drill deeper. Conventionally, this involves shutting down fluid circulation completely so the pipe can be connected into place as the top drive has to be disengaged.

Conventionally, the well bore is open to atmospheric pressure and there is no surface applied pressure or other pressure existing in the system. The drillpipe rotates freely without any sealing elements imposed or acting on the drill pipe at the surface, and flow is diverted at atmospheric pressure back to the fluid storage system at surface.

The bit penetrates its way through layers of underground formations until it reaches target prospects—rocks which contain hydrocarbons at a given temperature and pressure. These hydrocarbons are contained within the pore space of the rock (i.e. the void space) and can contain water, oil, and gas constituents—referred to as reservoirs. Due to overburden forces from layers of rock above, these reservoir fluids are contained and trapped within the pore space at a known or unknown pressure, referred to as pore pressure. An unplanned inflow of these reservoir fluids is well known in the art, and is referred to as a formation influx or kick and commonly called a well control incident or event.

Kick tolerance is simply defined as the maximum height (and hence, pressure) of an influx column that the open hole section (including the last casing shoe depth) can tolerate before the formation fractures or breaks down. Correctly calculating kick tolerance is essential to safe well design and drilling. There are two values necessary to define the kick tolerance of a wellbore. Kick intensity is the amount of overpressure that is penetrated when the well flows—i.e. the summation of the existing higher formation pressure penetrated and the bottom hole pressure at this point, but expressed as a density in pounds per gallon (ppg). For example if the mud density is 10 ppg and the kick intensity is 0.5 ppg, then the equivalent formation pressure of the "kicking" formation is the addition of these two values—10.5 ppg in this example.

The other value required is the influx volume—this is the quantity of gas/fluid which enters the well from the kicking formation. Therefore, increasing the rig's capability to reduce the influx volume which occurs into the wellbore reduces the risk of exceeding the kick tolerance for the well design.

Blow out preventers, referred to as BOP's, are used to seal and control the formation influxes described herein in the wellbore. These are well known in the art, and are compulsory pressure safety equipment used on both land and off-shore rigs. Land rigs have their BOP's generally secured to a well head at the top of the wellbore below the rig floor/deck on the surface. Deep water offshore rigs have their BOPs secured subsea to the well head at the top of a wellbore which is subsequently located on the ocean floor. In shallow offshore rigs (jack-ups, platforms, etc.), the wellhead is located at the ocean floor and a riser system connects this to a surface BOP situated directly below the rig floor deck.

Each BOP may comprise a blind &/or shear ram, pipe rams, or an annular preventer/annular BOP. The sealing elements of an annular BOP seal around the drill string, thus closing the annulus and stopping flow of fluid from the wellbore. They typically include a large flexible rubber or elastomer packing unit configured to seal around a variety of drillstring sizes when activated, and are not designed to be actuated during drillstring rotation as this would rapidly wear out the sealing element. A pressurized hydraulic fluid and piston assembly are used to provide the necessary closing pressure of the sealing element to allow for the capability if necessary to close or shut in the annulus during the course of drilling a well. Certification standards for Annular BOP's specify closure times of 45 seconds for ram BOP's and 60 seconds for annular BOP's. References to these standards can be found in API 1$^{st}$ Edition 16D, API 3$^{rd}$ Edition RP-53, Norwegian NPD YA-001A & IADC Chapter K2.

The primary function of a BOP is to prevent a blow out. The extended time duration from the time of activation to the time that a closed position is achieved as a result of the large volume of hydraulic fluid that must be displaced into the closing line and chamber of the BOP system, and pressurized to the required closing pressure of the BOP system. These are well known in the art.

A standard annular BOP typically comprises a sealing element, referred to as a packer, and actuator enclosed in a housing. The packer is composed of an elastomeric compound (typically Nitrile Rubber) bonded with metallic reinforcement. The actuator divides the housing into two cavities or chambers ("open" and "close" chambers). Fluid pressure is then used and injected on either side of the actuator to close and open the packer when required. An early design of annular BOP is disclosed in U.S. Pat. No. 2,609,836.

In the event that an undesired well kick or formation influx is detected at surface, in a typical drilling system, the mud pumps are immediately shut down, and the rig BOP closed. Where the rig BOP comprises a BOP stack including a plurality of different BOP types, one of which is an annular BOP, it is most common to activate the annular BOP as it has the greater capability of sealing on varying dimensions and geometries of the drill string as well as full closure on open hole. The fluid from the annulus, which includes the influx, is circulated through the rig choke manifold and directed to the rig mud gas separator or Poor Boy, where the fluid is degassed. The separated gas is vented to the vent line which extends up the height of the derrick, and the fluid is redirected to the rig shaker and mud tank system. There is the option to send all returns overboard if flooding of the rig mud gas separator occurs such that carry over through the derrick vent line is prevented. Normally, the shut in procedure with the rig BOP takes at least 45 seconds when a ram BOP is used, or at least 60 seconds when an annular BOP is used.

According to a first aspect of the invention we provide a method of drilling a well bore according to any one of claims 1 to 18.

According to a second aspect of the invention we provide an apparatus for drilling a well bore according to any one of claims 19 to 40.

According to a third aspect of the invention we provide an apparatus for drilling comprising a substantially annular packer element disposed within a housing, which is capable of closing in and/or sealing off a drill string closure in 5 seconds or less.

The apparatus may comprise one or more of: a quick closing annular, a flow spool, a hydraulic system and accumulator, and a pressure relief system (which may be integrated).

The apparatus may further comprise any feature or combination of features disclosed herein.

According to a fourth aspect of the invention we provide a method for drilling comprising the use of a substantially annular packer element disposed within a housing, and closing in and/or sealing off a drill string closure in 5 seconds or less.

Embodiments of the invention will be described, by way of example only, with reference to the accompanying figures of which:

Figure 3:
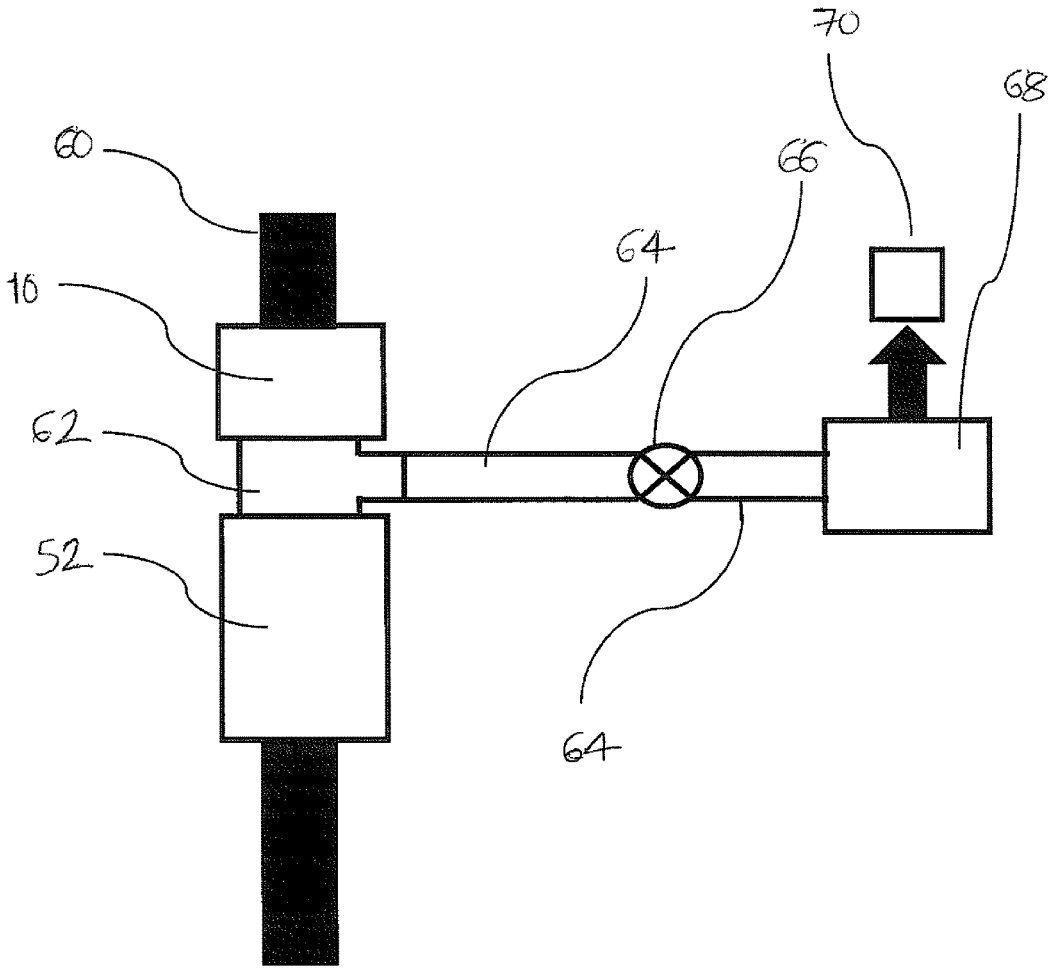
Figure 4:
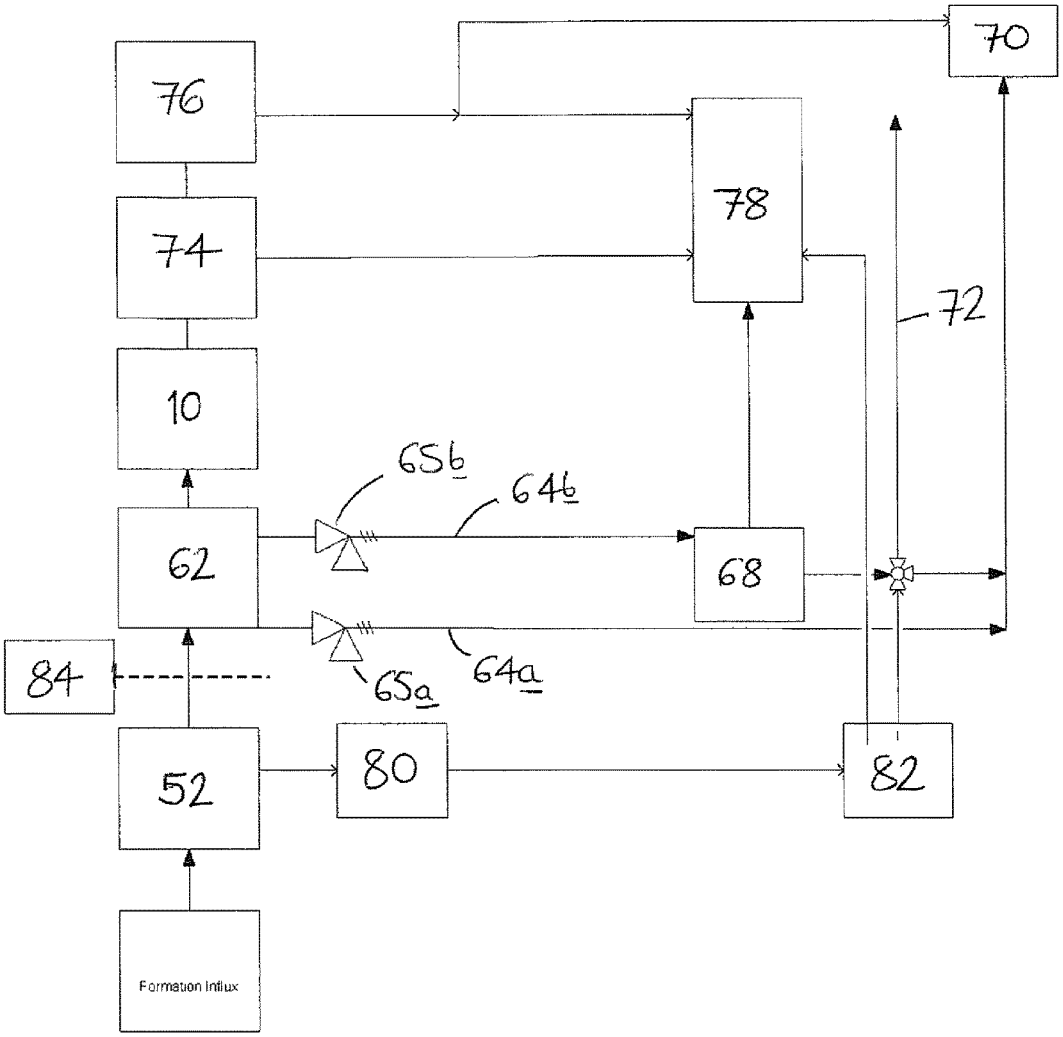
Figure 5:
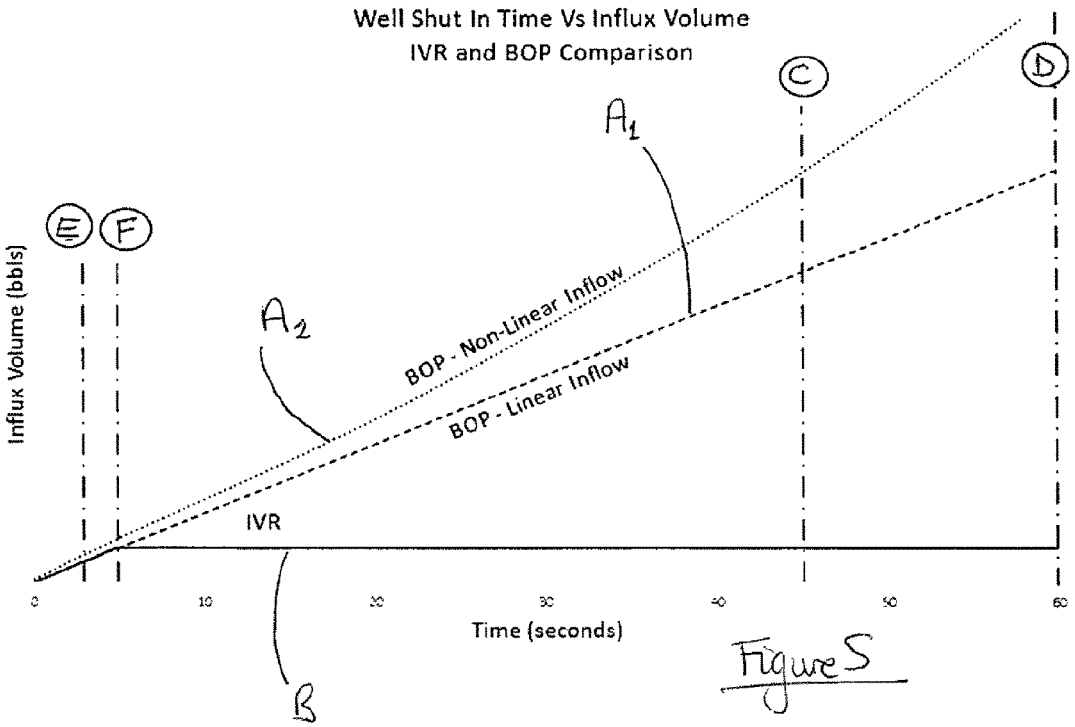
Figure 6:
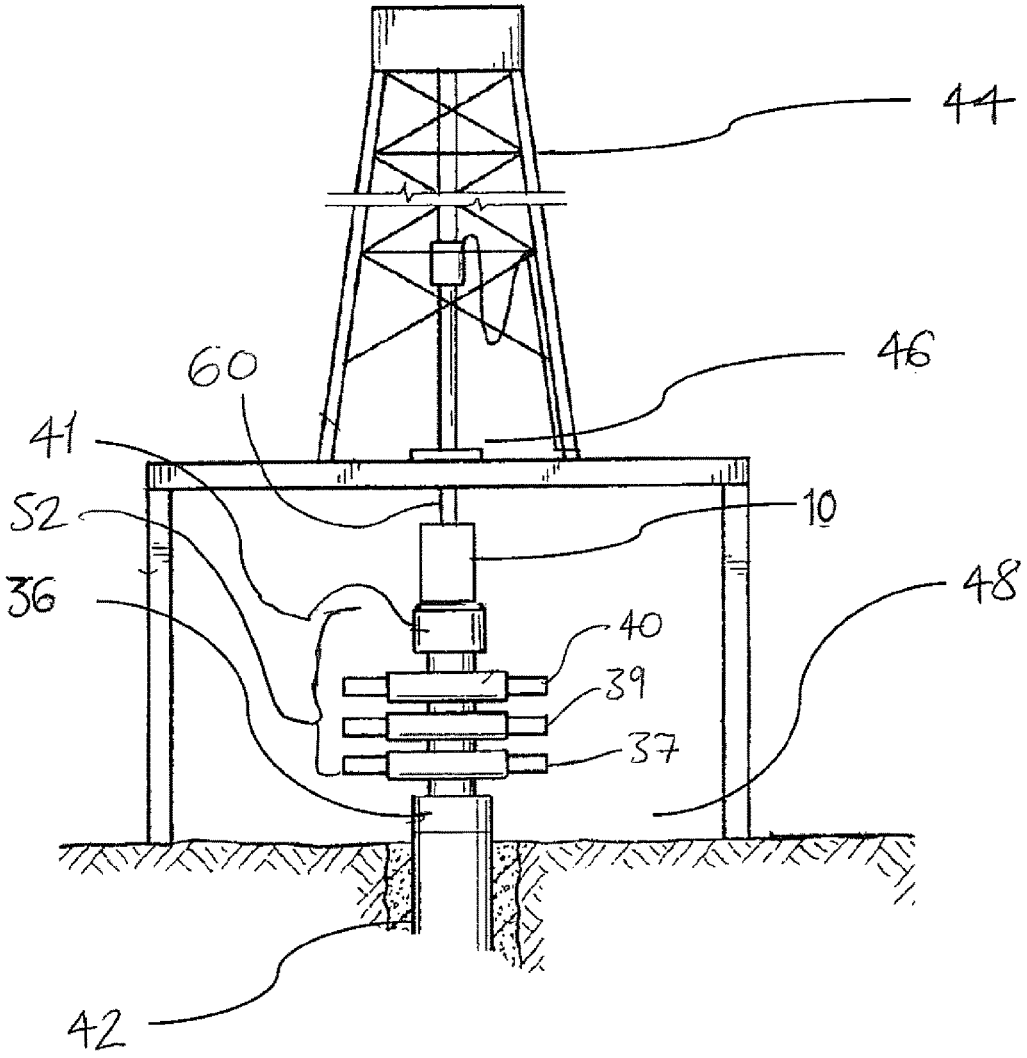
Figure 7:
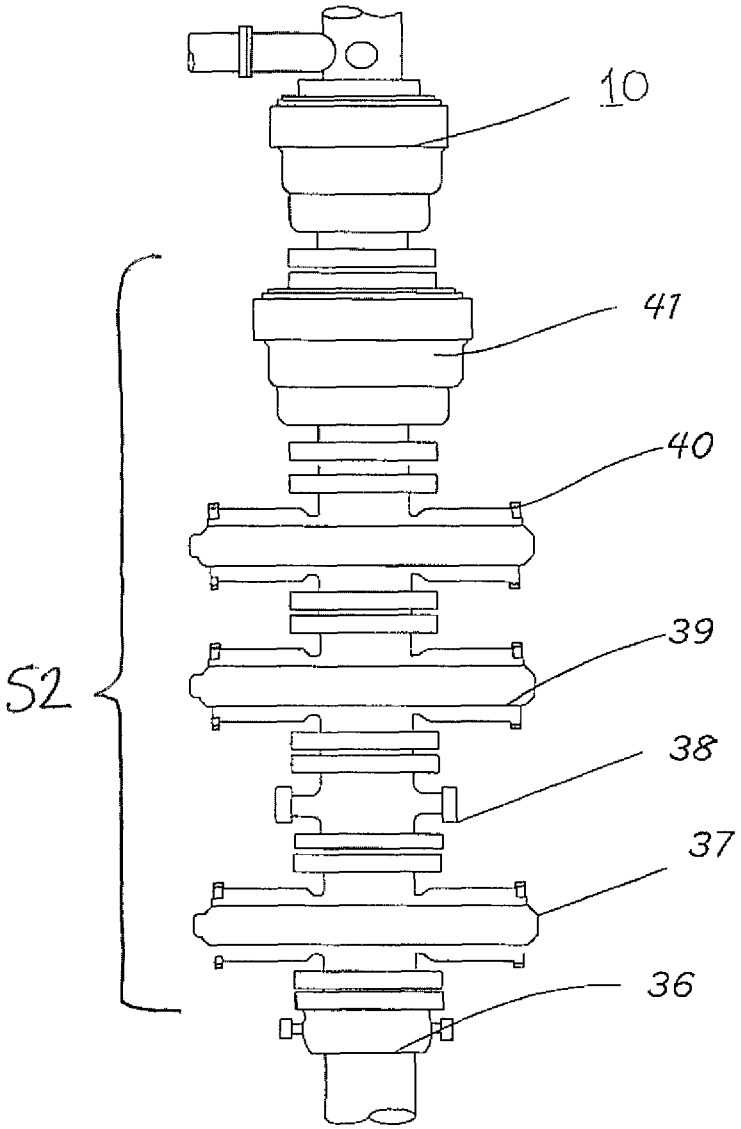
Figure 8:
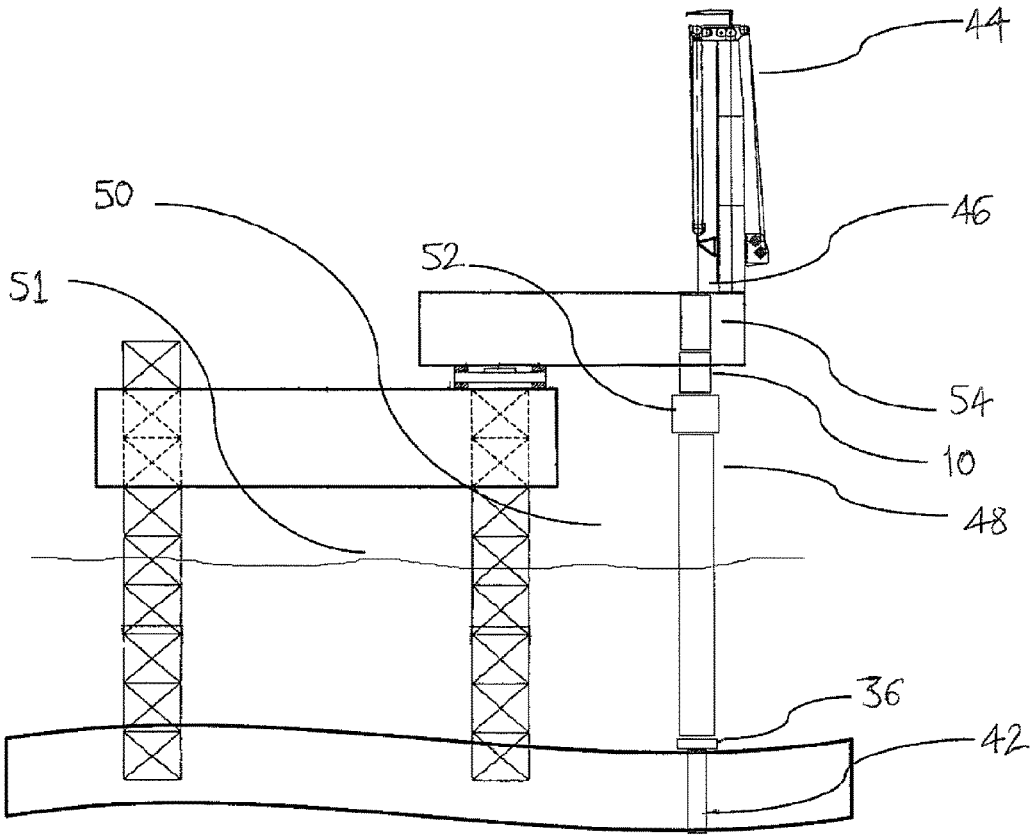
Figure 9:
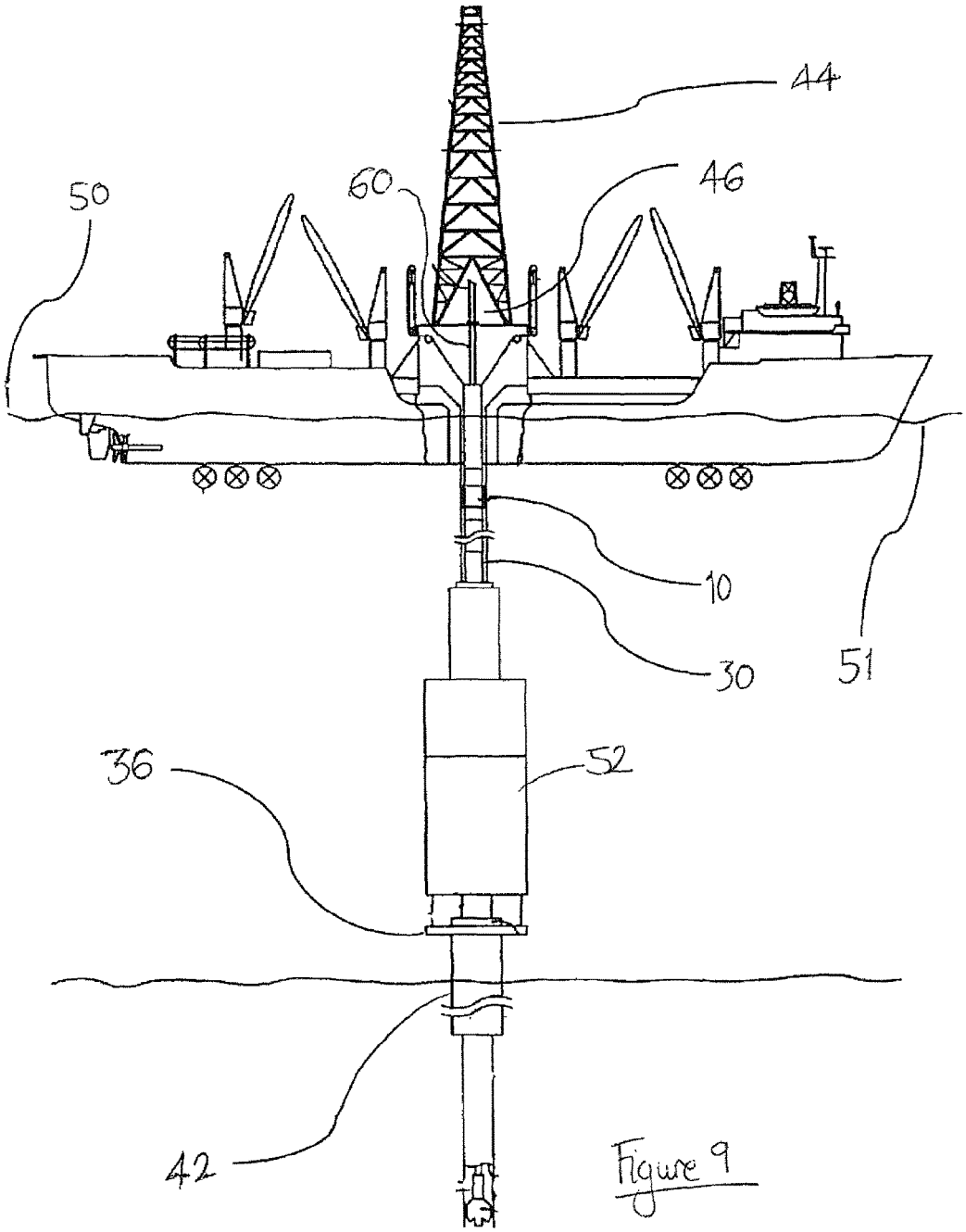
Figure 10:
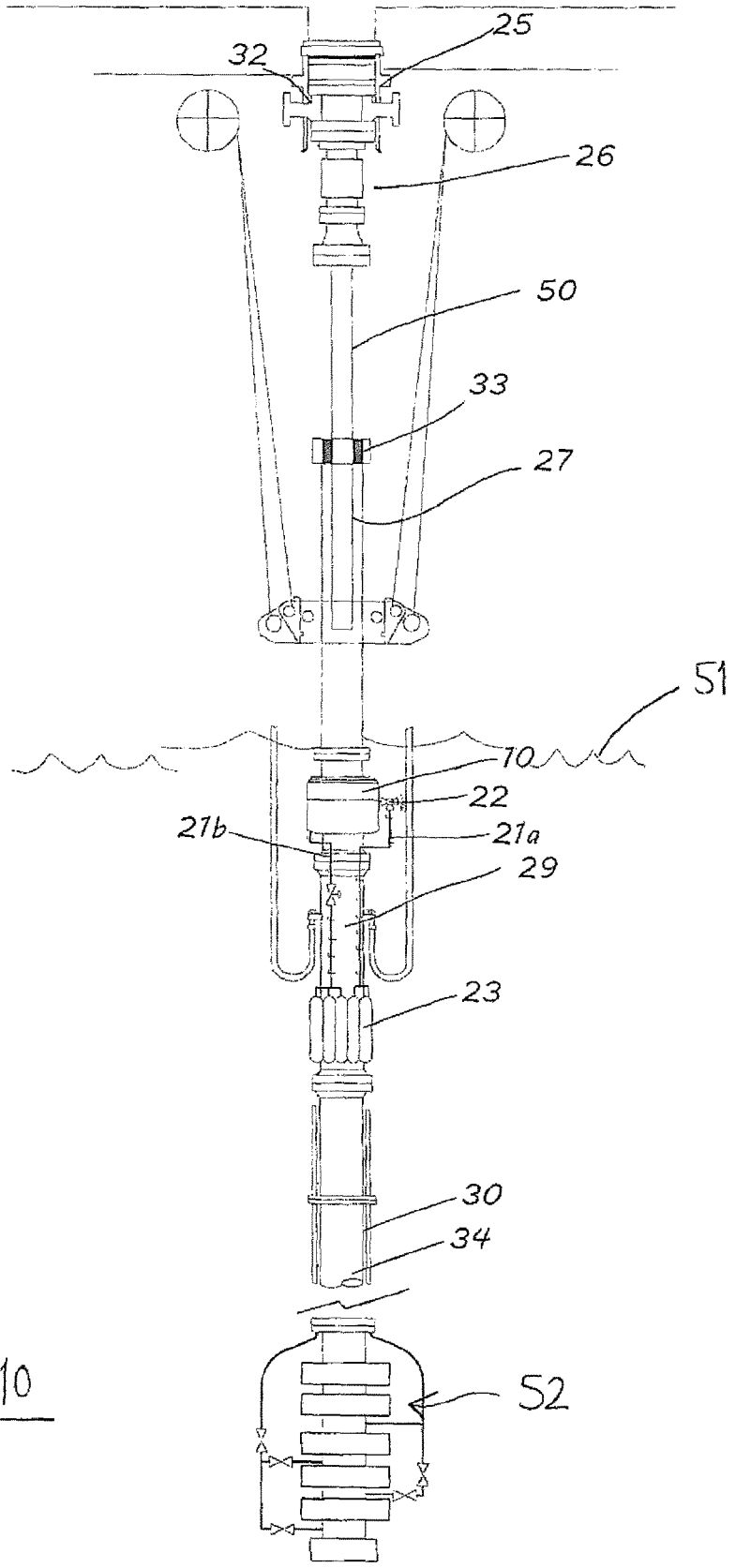
Figure 11:
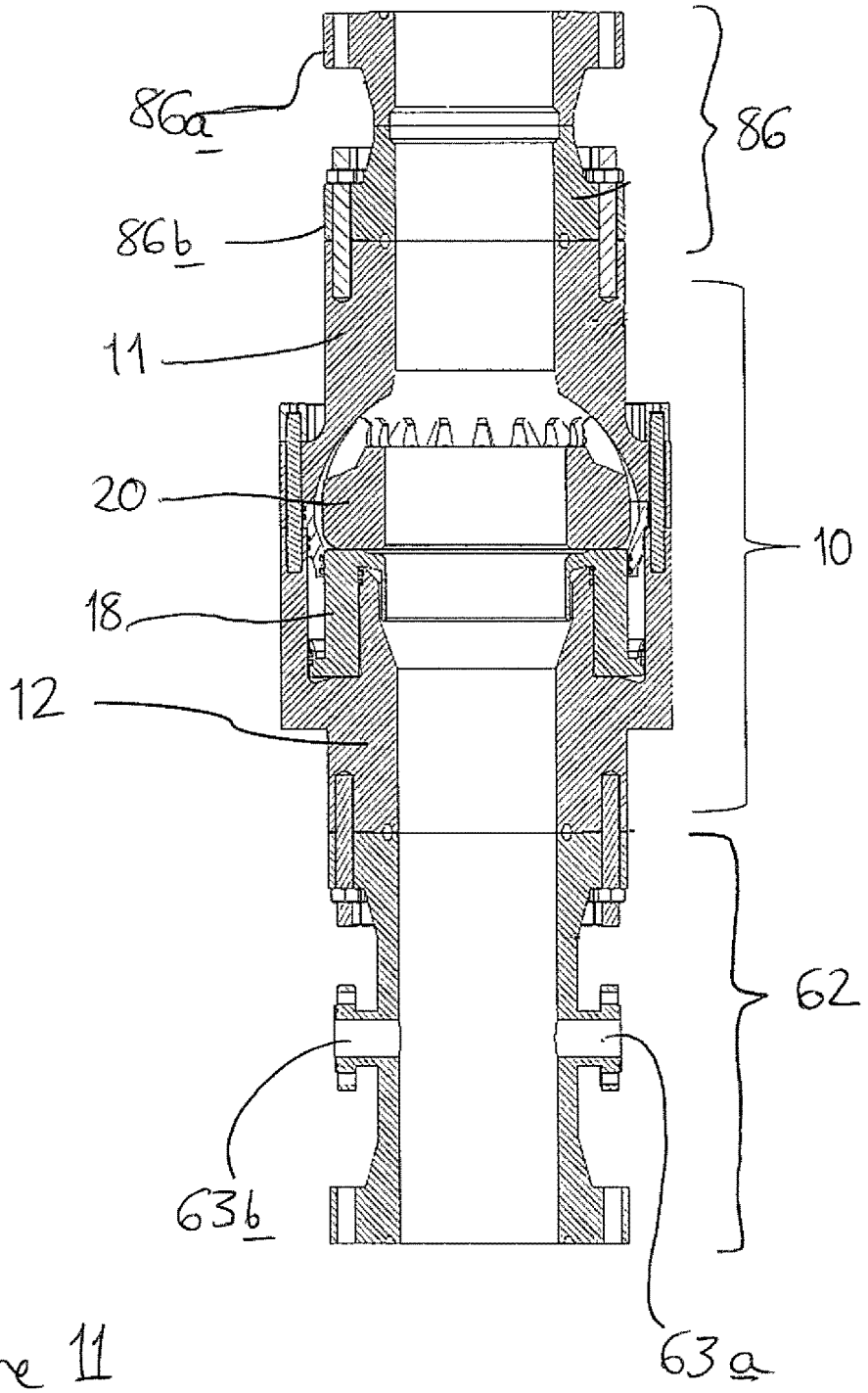
Figure 12:
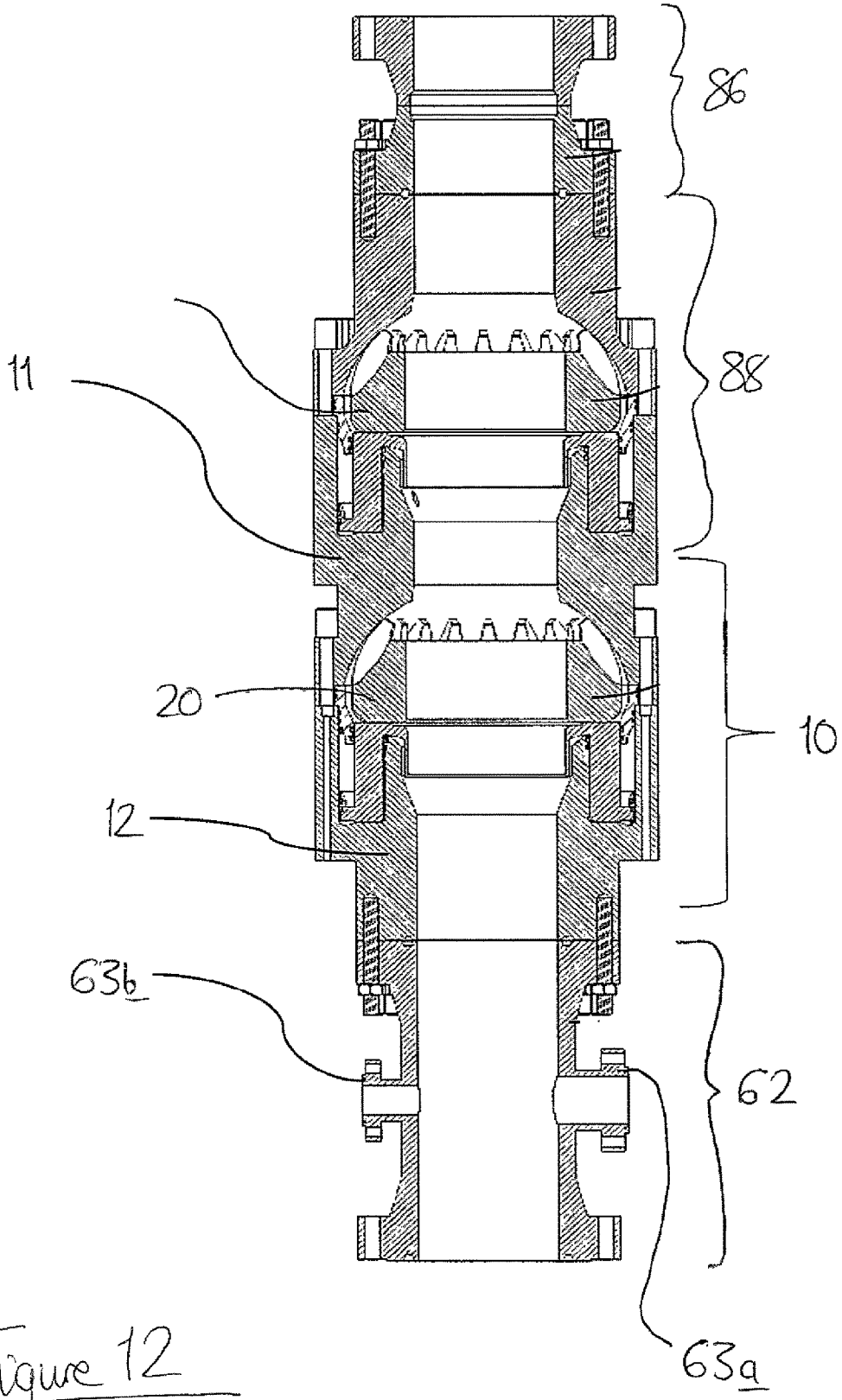
Figure 13A:
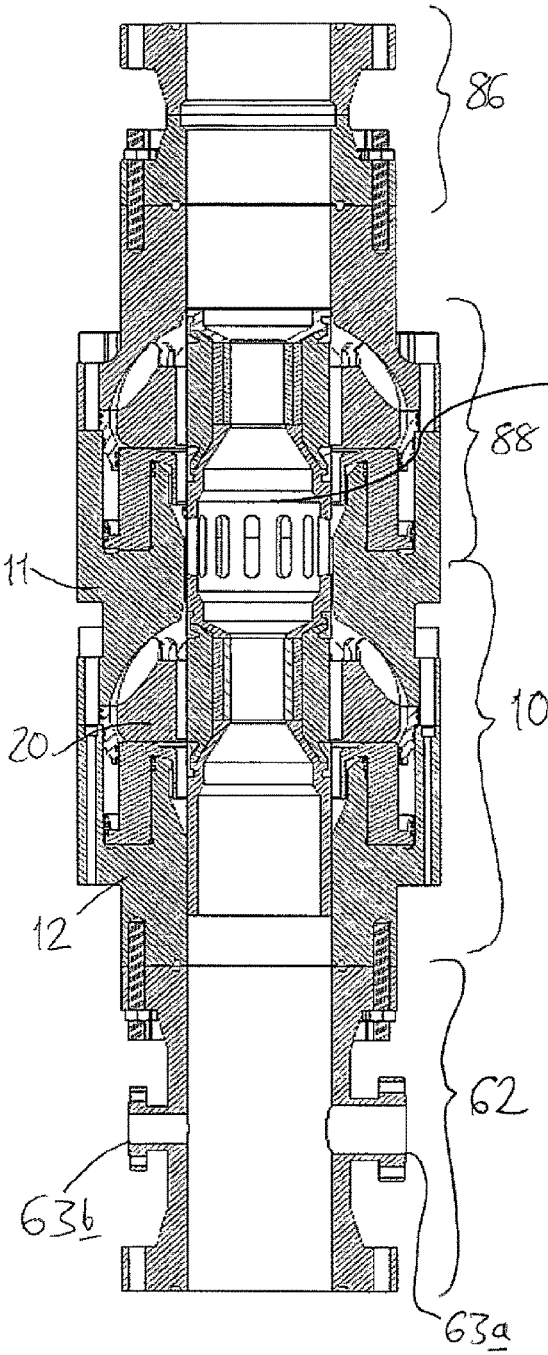
Figure 13B:
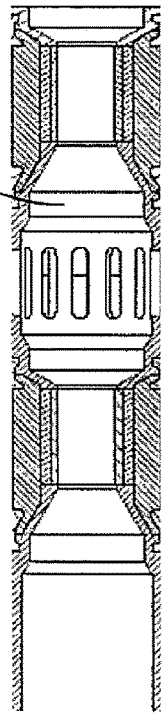

FIG. 3 shows a schematic illustration of a portion of a drilling system according to the invention, FIG. 4 shows a further schematic illustration of a drilling system according to the invention, FIG. 5 shows an example of a plot of influx volume versus time for a prior art drilling system and a drilling system according to the invention, FIG. 6 shows an illustration of a land-based drilling rig including a drilling system according to the invention, FIG. 7 shows an illustration of one example of BOP stack suitable for use in the drilling system illustrated in FIG. 6, FIG. 8 shows an illustration of a shallow water off-shore drilling rig including a drilling system according to the invention, FIG. 9 shows an illustration of a deep water off-shore drilling rig including a drilling system according to the invention, FIG. 10 shows a more detailed illustration of aspects of the deep water drilling rig illustrated in FIG. 9, FIG. 11 shows an illustration of an embodiment of BOP and flow spool suitable for use in a drilling system according to the invention, FIG. 12 shows an illustration of an alternative embodiment of BOP and flow spool suitable for use in a drilling system according to the invention, FIG. 13*a* shows an illustration of a further alternative embodiment of BOP and flow spool suitable for use in a drilling system according to the invention, and FIG. 13*b* shows the sealing sleeve assembly used in the BOP shown in FIG. 13*a*.

Figure 1:
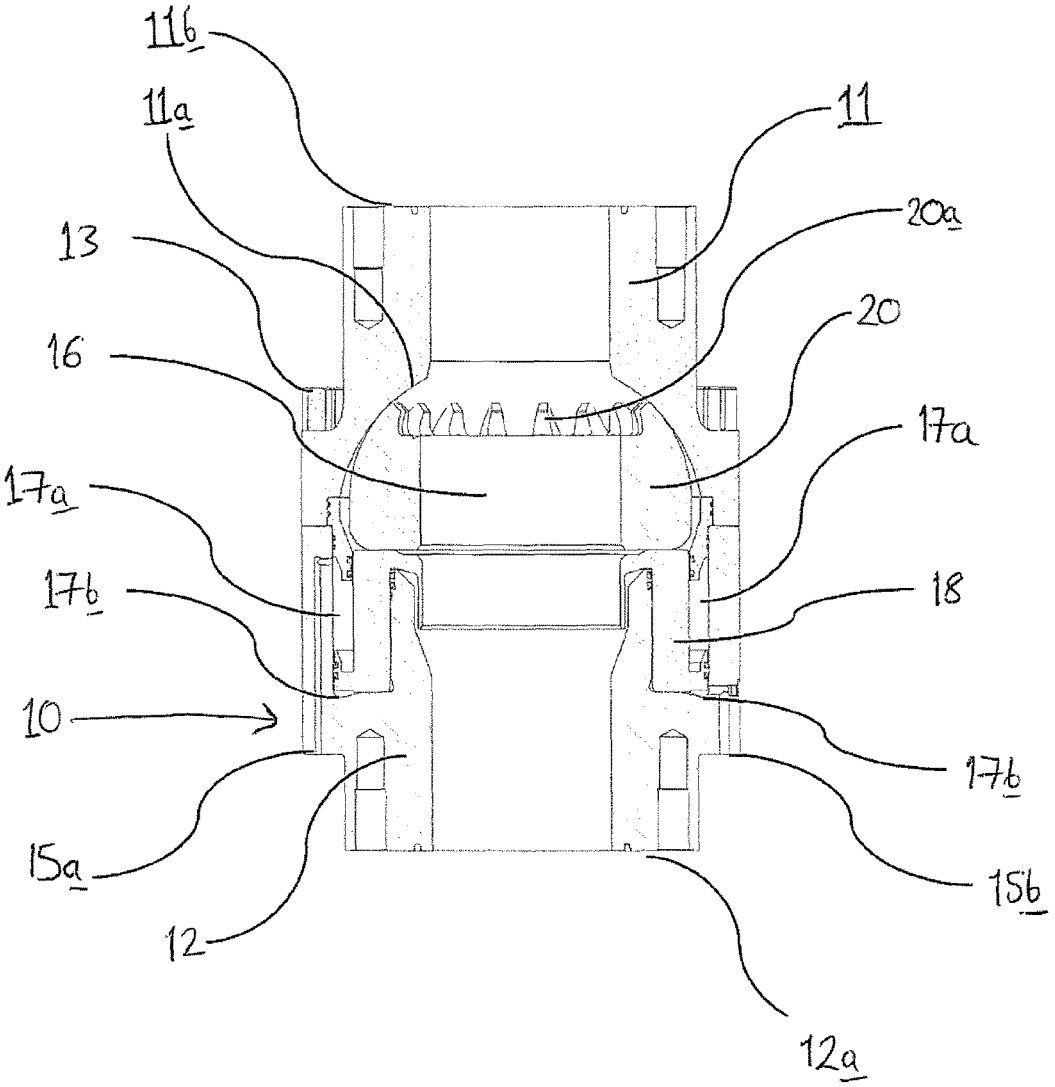
FIG. 1 shows an illustration of a longitudinal cross-section through one embodiment of BOP suitable for use in the invention.

Referring now to FIG. 1, there is shown a blowout preventer (BOP) 10, which comprises a housing which has a longitudinal axis and which is divided in a first housing part 11 and a second housing part 12, movement of the first housing part 11 relative to the second housing part 12 being prevented by fasteners 13, each fastener including a shaft which extends through a fastener receiving passage provided in the first housing part 11 into a fastener receiving passage provided in the second housing part.

The first housing part 11 has an upper flange connection 11*b* which is detailed as being a studded flange 18.75 inch 5000 psi, and is an integral part of the first housing part 11. The second housing part 12 has a lower flange connection 12*a* which is detailed as being a studded flange 18.75 inch 5000 psi, and is also an integral part of the second housing part 12. While this embodiment of BOP incorporates this studded flange sizing and design, it is not limited to this and may incorporate other standard flanges of varying sizes and pressure ratings for compatibility to any system it is configured with and resulting in simplified installation.

Located within the housing is a sealing element 20, which in this example comprises a torus shaped packing element made from an elastomeric material such as rubber with metallic inserts 20*a*, and a fluid pressure operated actuator, in this example a piston 18. The piston 18 divides the interior of the housing into two chambers (an "open chamber 17*a*" and a "close chamber 17*b*"), and substantially prevents flow of fluid between the two chambers 17*a*, 17*b*.

This configuration of BOP is described in more detail in our co-pending UK patent application, GB 1104885.7 and further referenced in UK patent application GB 1204310.5 (filed 12 Mar. 2012) and U.S. patent application Ser. No. 13/443,332 (filed 10 Apr. 2012) the contents of which are incorporated herein by reference. It should be appreciated, however, that the invention is not restricted to use in conjunction with this type of BOP. The invention may be used with any type of fluid pressure operated BOP—whether an annular, a spherical or a ram BOP.

The piston 18 is movable, by means of the supply of pressurised fluid to the close chamber 17*b*, to push the packing element 20 against a curved portion 11*a* of the first housing part 11, which causes the packing element 20 to be compressed and its diameter to reduce. When a drill pipe is located in the BOP 10, this causes the packing element 20 to constrict around and enter into sealing engagement with the drill pipe. Where no drill pipe is present (i.e. an open well bore), if sufficient pressure is applied to the close chamber 17*b*, the packing element 20 may be compressed so much that its central aperture disappears and it acts as a plug, preventing flow of fluid through the BOP 10 (this may be referred to as full closure). In either case, the BOP 10 is in its closed position. The packing element 20 is released from sealing element from sealing engagement with the drill pipe or itself by the supply of pressurised fluid to the open chamber 17*a*.

Figure 2:
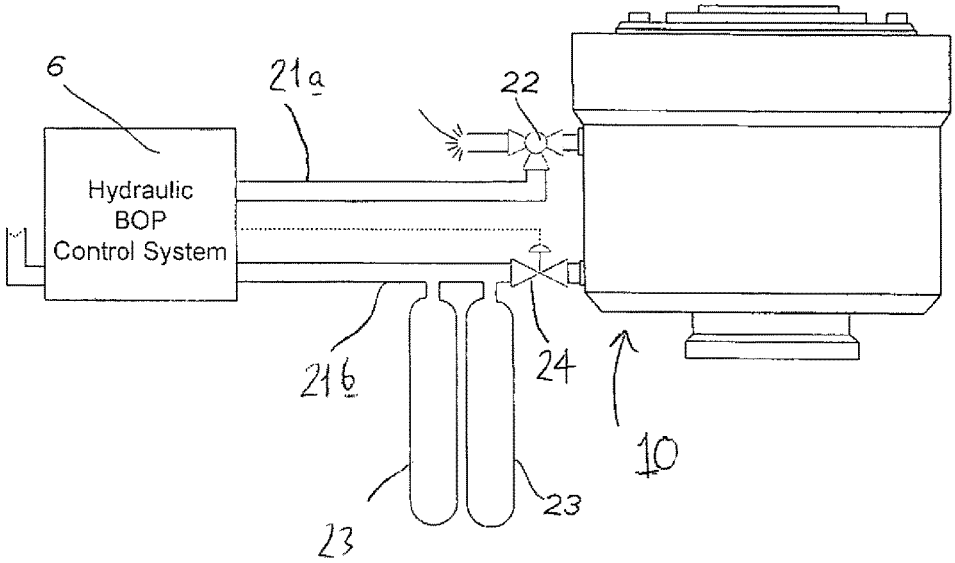
FIG. 2 shows a schematic illustration of an embodiment of BOP and BOP control system suitable for use in the invention.

Referring now to FIG. 2, there is shown an open line 21*a* which is connected to the open chamber 17*a* via a first fluid flow passage 15 through the second housing part 12. There is also shown a close line 21*b* which is connected to the close chamber 17*b* via another a second fluid flow passage 15*b* through the second housing part 12. Preferably the close line 21*b* is a relatively large bore conduit (2 inches and above). The open line 21*a* is may also be similarly sized.

The fluid flow passages 15*a*, 15*b* in the BOP housing are typically 1 inch in diameter, so to give the connection between the open chamber 17*a* or the close chamber 17*b* and the lines 21*a*, 21*b* at the exterior of the housing the equivalent flow area to a 2 inch diameter, four fluid flow passages may be manifolded together for each of the open and close lines 21*a*, 21*b*. Alternatively, each of the fluid flow passages may be connected to a separate open or close line of smaller than 2 inches in diameter (1 inch diameter, for example), the total flow area provided by all the open or close lines being greater than or equal to the flow area provided by a single 2 inch diameter pipe.

A quick dump shuttle valve 22 is provided in the open line 21*a* directly adjacent the BOP housing. This valve 22 has a vent to atmosphere, and is a three-way shuttle valve which is movable between a first position in which fluid flow along the open line 21*a* is permitted, and a second position in which the open chamber 17*a* is connected to the vent to atmosphere.

Typically, the quick dump shuttle valve 22 is biased (advantageously by means of a spring) into the second position, and moves against the biasing force into the first position when there is sufficient pressure in the open line 21*a*.

An electrically or electronically operable close control valve 24 is provided in the close line 21*b* directly adjacent the BOP housing. This valve 24 is movable (for example by means of a solenoid or piezoelectric element) between a closed position in which flow of fluid along the close line 21*b* is substantially prevented, and an open position, in which flow of fluid along the close line 21*b* is permitted. Preferably, biasing means is provided to bias the valve 24 to the closed position, and supply of electrical current to the valve 24 causes the valve 24 to move to the open position.

Control of the supply of electrical current to the close control valve 24 is carried out by an electronic control unit in a hydraulic BOP control system 6 which is located remotely from the BOP 10, typically in a BOP control room.

The control system 6 also comprises a pump which is operable to draw fluid from a fluid reservoir and which is connected, via a valve or plurality of valves, to the open line 21*a* and the close line 21*b*. In preferred embodiment of the invention, the fluid is a non-corrosive, non-foaming environmentally-friendly fluid such as water containing a small amount of corrosion inhibitor. A non-return valve is provided in each of the open line 21*a* and close line 21*b* to prevent back flow of fluid towards the pump.

The valves of the control system 6 are electrically or electronically operable to direct fluid from the pump to either the open line 21*a* or the close line 21*b*. Preferably, operation of this valve or valves is controlled by the electronic control unit which controls operation of the close control valve 24.

Two accumulators 23 are provided in the close line 21*b*, close to or directly adjacent the close control valve 24. For a land installation, this means that the accumulators are as close to the BOP housing as reasonably practicable, bearing in mind restrictions and regulations on the placement of pressurised accumulator bottles in fire hazard areas. For an off-shore installation, the accumulators are preferably no more than 15 ft from the close chamber.

These accumulators 23 are of conventional construction, and in this example comprise a bottle, the interior of which is divided into two chambers by a diaphragm. The chamber at the closed end of the bottle is filled with an inert gas, and the other chamber is connected to the close line 21*b*. Thus, operating the control system 6 to pump fluid along the control line 21*b* whilst the close control valve 24 is in the closed position will cause pressurised fluid to be stored in the accumulators 23.

It should be appreciated, of course, that one or more than two accumulators 23 may equally be provided.

During normal use, the quick dump shuttle valve 22 is in its second position, i.e. with the open chamber 17*a* venting to atmosphere, the accumulators 23 are pressurised to a predetermined pressure, the close control valve 24 is in its closed position, the pump is inactive, and the valves in the control system 6 are arranged such that the pump output is connected to the close line 21*b*. In order to close the BOP 10, the electronic control unit of the control system 6 is programmed to operate the close control valve 24 to move it to its open position, and to activate the pump to pump fluid along the close line 21*b*. Pressurised fluid is thus supplied to the close chamber 17*b* of the BOP 10, which then moves to its closed position, whilst the fluid expelled from the open chamber 17*a* is vented to atmosphere at the quick dump shuttle valve 22.

The control system 6 may control the pressure applied to any drill string extending through the BOP 10 by the packing element 20, by controlling the pumping of fluid into the close chamber 17*b* so that the pressure of the fluid in the close chamber 17*b* reaches a desired level.

By positioning the accumulators close to the BOP 10, and using a relatively large diameter close line 21*b*, there is minimal time delay after the opening of the close control valve 24 before the pressurised fluid starts to reach the close chamber 17*b*. Moreover, using a relatively large diameter open line 21*a*, and venting the open chamber 17*a* to atmosphere at the quick dump shuttle valve 22 minimises the resistance exerted by the fluid in the open chamber 17*a* opposing this movement of the piston 18.

These factors combined means that particularly rapid closing of the BOP 10 can be achieved. In fact, for BOP 10 with an outer diameter of 46.5 inches and a 21¼ inch inner diameter mounted around a 5 inch drill pipe, complete closing of the BOP 10 can be achieved in 3 seconds or less. The closing time can be reduced by increasing the number of accumulators 23 in the close line 21*b*. This quick response time is highly desirable since most oil and gas exploration companies have policies to advocate the "Hard shut in" method. The main advantage of using the hard shut-in method is that the well is shut in with no delay, resulting in less formation fluid entering the well, and a resultant lower shut in casing pressure which may not exceed the kick tolerance of the well.

To open the BOP 10, the electronic control unit of the control system 6 is programmed to operate the valves in the control system 6 to connect the pump output to the open line, and to activate the pump. Pressurised fluid is thus supplied to the open chamber 17*a*, and the piston moves back to return the BOP 10 to its open position. The fluid from the close chamber 17*b* is returned to the reservoir via the control system 6.

In an alternative embodiment, rather than venting to atmosphere, the vent of the quick dump shuttle valve 22 may be connected to a fluid reservoir (which may be the reservoir from which the pump draws fluid) via a pipe which has a significantly larger diameter than the open line 21*a* and the close line 21*b*. By using a relatively large diameter pipe, flow of fluid out of the open chamber 17*a* is relatively unimpeded, and, again, there is little resistance to movement of the piston 18 to the closed position. This embodiment may be preferred where the BOP 10 is used on a land-based drilling rig, rather than offshore.

Advantageously, the BOP 10 has compact geometrical dimensions which will allow it to be drifted through standard 49½" inch rotary tables used in drilling for easy and safe installation. Ideally, the outside diameter (OD) of the BOP 10 will not exceed a 46.5" OD.

The BOP 10 and control system described above will hereinafter be referred to as the quick closing annular (QCA) 10 to distinguish it from conventional BOPs.

FIG. 3 shows a schematic illustration of key components of a drilling system (hereinafter referred to as the influx volume reduction system IVR) including the QCA 10 and associated control system described above. The QCA 10 is mounted above a conventional BOP or BOP stack 52 with a flow spool 62 between the BOP/BOP stack 52 and the QCA 10. The BOP/BOP stack 52 is connected to a well, and a drillpipe 60 extends from surface, through the internal diameters of the quick QCA 10, the flow spool 62, the BOP/BOP stack 52, and into the well below. The flow spool 62 is connected to any point above the BOP/BOP stack 52 and below the QCA 10, either directly on top or at some point above the BOP/BOP stack 52. The QCA 10 may be connected directly on top of the flow spool 62 or at some point above the flow spool 62. Crossovers to the correct connection types may or may not be needed to integrate this system into any existing drilling rig system &/or BOP configuration whether land based or offshore.

A pressure relief line 64 is connected to a side outlet located on the flow spool 62. The pressure relief line 64 is connected to a pressure relief valve 66, which is set at a predetermined value that will activate when the pressure below the QCA 10 approaches the lowest pressure limits of any of the well formations and casing, and/or the surface equipment, including the QCA 10, the riser 30, the BOP/BOP stack 52, the flow spool 62, and/or any other equipment connected to the system. Downstream of the pressure relief valve 66, the pressure relief line 64 further connects to a mud gas separator 68 or to an overboard flow diversion point 70 offshore which vents to a safe point away from the operation. This allows the pressurized fluid which may or may not contain gas to be directed safely away from the operation to be depressurized safely and in a controlled manner. The mud gas separator 68 will vent all gas to a vent line 72 located at a safe distance away from the rig and return the fluid volume fraction of the relief flow stream to the rig's fluid storage system.

FIG. 4 illustrates the process flow diagram for the IVR system once an influx occurs into the wellbore.

During drilling, fluid flow from the wellbore circulates up the annulus, through the rig BOP 52, through the flow spool 62 and QCA 10 and up into the rig's diverter bell nipple/bell nipple 74 or diverter assembly 76. The flow is redirected to the rig shakers and mud tank system 78 via a flow line equipped with a flow indicator sensor, where cuttings are removed and the drilling fluid is processed to remove formation cuttings before being pumped back down into the well through the drill pipe 60.

When a formation influx occurs into the wellbore, and as soon as the influx is detected at surface the pumps are immediately shut down.

In a conventional, prior art system, the rig BOP 52 would be closed, and the influx would be managed/controlled through the rig well control system—circulated through the rig choke manifold 80, with all returns sent to the rig mud gas separator or Poor Boy 82, where fluid is degassed. The separated gas is vented to the vent line 72 which extends up the height of the derrick, and the fluid is redirected to the rig shaker and mud tank system 78. There is the option to send all returns overboard at the overboard flow diversion point 70 if flooding of the rig mud gas separator 82 occurs such that carry over through the derrick vent line 72 is prevented. Normally, the rig BOP 52 will take from initiating closure to closure of the BOP, a minimum of 45 seconds with a ram BOP a 60 seconds with an annular BOP. Often the entire procedure takes up to 2 minutes, over which time the formation will continuously inflow into the wellbore annulus creating larger influx volumes to manage at surface and potentially exceeding the kick tolerance value of the wellbore.

When using the present invention, however, the rig BOP 52 and the QCA 10 are both activated (i.e. operated to close the annulus)—the QCA 10 shuts in the annulus almost immediately as described in relation to FIG. 2 above, with the drill pipe 60 still present in the wellbore. Using the QCA 10 as described above may well result in bore closing times which are, for example, a factor of 10 times faster than conventional BOP systems. The closing of the QCA 10 takes less than 3 seconds, and this rapid closing action prevents large volumes of formation influx from entering the well, because as the annulus seals the bottom hole pressure will balance with the formation pressure quickly and thus inflow volumes into the wellbore are minimized.

The QCA 10 can also be actuated to quickly seal off the riser top when gas has been circulated undetected to surface. Additionally, the QCA 10 closes much quicker—3 seconds versus 30-45 seconds for a surface rig diverter 76, and therefore the IVR system will have an enhanced response time for sealing off the annulus immediately after kick detection, further reducing the risk of uncontrolled gas and fluid release at surface. The hydraulic control system 6 for the QCA 10 can be operated as described above to adjust the pressure of fluid in the close chamber 17*b* of the QCA 10 so as to ensure that the initial pressure applied to the drill pipe by the sealing element 20 will also allow for the stripping of the drill string to occur if necessary. In this example, the QCA 10 is actuated immediately upon influx detection, after which the rig's conventional well control procedures are also implemented to close the rig BOP 52. It should be appreciated, however, that the conventional well control procedures may be initiated at substantially the same time as the QCA 10 is activated, i.e. both procedures being initiated immediately upon influx detection.

Once the QCA 10 is closed, there may be potential for the system to overpressure from either increasing surface pressure from the influx in the annulus, or failure to stop the pumps before the QCA 10 closes. The QCA 10 pressure rating is typically lower than that of the flow spool 62 and the BOP/BOP stack 52 and riser sections below it, and therefore there is a pressure break 84 between the flow spool 62 and the BOP 52 components below the IVR system. To mitigate this, in this example, a pressure relief system 64, 65 is connected to the flow spool 62. The pressure relief system may consist of one or more relief valves 65*a*, 65*b* and lines 64*a*, 64*b*, with each relief line 64*a*, 64*b* being independent of the other. In this example, two independent pressure relief lines 64*a*, 64*b* are provided, each with its own pressure relief valve 65*a*, 65*b*, one extending to the mud gas separator 68 and the other to the overboard diversion point 70. The relief valves 65*a*, 65*b* are set at the lowest pressure rating in the drilling system (formation, riser components etc.) which exists below the sealing point of the QCA 10.

When the pressure below the sealing point of the QCA 10 approaches the set points of the pressure relief valves 65*a*, 65*b*, the valves 65*a*, 65*b* will actuate and relieve the riser pressure immediately, directing the flow to either a mud gas separator 68 where fluid will depressurize in a safe and controlled manner, or directly to the overboard flow diversion point 70. In this example, the pressure relief valve 65*a* connected to the mud gas separator 68 may be set to open at a slightly lower pressure than the pressure relief valve 65*b* connected to the overboard diversion point 70. This will allow more controlled pressure relief to the mud gas separator 68 initially, with the overboard diversion relief valve 65*b* activating if pressure continues to climb in the system. Fluid will be returned to the rig shaker and mud tank system 78 and gas will vent to the vent line 72 extending up the derrick. There will be an option to divert the flow overboard downstream of the mud gas separator 68 if the vessel begins to flood with fluid—this will prevent liquid carry over through to the derrick vent line 72. Thus over-pressuring of the system will be mitigated with the pressure relief valves 65*a*, 65*b*. Alternatively, the discharge of the pressure relief valves 65*a*, 65*b* could be routed to the rig's existing mud gas separator/Poor Boy 82. The routing of the relieved flow stream can be performed by means of a 3-way operated valve.

FIG. 5 illustrates the well shut in times and resultant influx volume behaviour of the conventional prior art drilling system and the system of the present invention when operated to deal with an influx as described above. This shows a graph of influx volume against line, with lines $A_1$ and $A_2$ showing the influx flow in the conventional, prior art, system, and line B showing the influx flow in the system of the present invention. In both systems, an identical formation begins to influx into the annulus. The time is set to zero when the influx/kick has been detected on surface, the rig pumps have been turned off, and the rig is ready to initiate well control procedures and shut in the well.

In the conventional system, the BOP will take between approximately 45 seconds (line C on FIG. 5) and 60 seconds (line D on FIG. 5) to shut in the well and seal around the drillpipe. For this example, an influx flow rate of 1 barrel per minute influx was assumed (0.017 barrels per second). Line $A_1$ illustrates a theoretical linear relationship of influx volume versus time which may occur for the total influx volume entering the well over the 45 to 60 seconds it takes for the BOP to close. The formation will continue to free flow into the annulus at 0.017 barrels per second until the annulus is sealed by the BOP.

However, the more likely behaviour will not be a linear relationship, but a non-linear relationship for increasing influx volume in the annulus. As the formation continues to free flow into the annulus, its lighter density will infiltrate the existing higher density drilling fluid system and begin to lighten the fluid column at the bottom of the well. This will decrease the bottom hole pressure further which will result in the formation influx rate to increase as the pressure differential increases between the formation pressure and the bottom hole pressure. This relationship between the increases in inflow rate with increasing pressure differential is defined in Darcy's Law for fluid flow through a porous medium, and is well known in the art.

Line $A_2$ illustrates this non-linear relationship between influx volume and time, and is the more realistic behaviour which will result while the conventional BOP is closed to shut in the well. The longer it takes to achieve sealing off the annulus the larger the influx volume will be from a continuously increasing inflow rate. The result is that there will be a much higher influx volume than anticipated by the linear relationship, and hence greater risk to manage and control the influx when it reaches surface. This could potentially exceed the kick tolerance for the wellbore design and/or and breach the safety limits of well control and surface equipment, while removing the influx from the annulus.

Line B illustrates the influx volume vs. time relationship when the present invention is employed. In this case, it takes approximately 3 seconds (line E in FIG. 5) to shut in the well and seal off the annulus when there is a drillpipe in the well, or around 5 seconds (line F in FIG. 5) when there is no drillpipe. Assuming the same influx rate of 1 barrel per minute (0.017 barrels per second), the plotted trend line B clearly illustrates the significant reduction in influx volume through rapidly sealing off the annulus within this time interval. By sealing off the annulus rapidly, the formation and bottom hole pressures balance immediately which reduces the volume of the influx by a large factor when compared to that of a conventional BOP system. Due to the much smaller volume of the influx it will be much safer to manage and control the influx during its removal from the well.

Additionally, by having the system of the present invention installed into a riser configuration, the kick tolerance (i.e. the maximum influx volume or pressure that can be accommodated before formation fracture or breakage occurs) in the well design could be reduced due to the capability to shut in the well rapidly. There will be a high level of control over influx volume, with the capability of the IVR to significantly reduce the volume of influx which could enter the annulus. This may keep wellbore pressures and volumes to a minimum during the removal of the influx volume from the wellbore, and thus may ensure that the influx can be safely managed and controlled at surface with the existing safety equipment and without breaching well bore and equipment safe operating limits. This not only introduces a large safety factor into the well design, but also may result in considerable cost savings on a well to well basis for the operator. Otherwise formation and/or casing shoe fracturing may result from larger influx volumes associated with a slower closing conventional BOP system.

It will be appreciated, therefore that the IVR provides a system and method to effectively close in the annulus as quickly as possible once a kick/influx has been detected, such that the total volume of reservoir fluid and hydrocarbons ingress to the well bore is minimized and prevention of subsequent potential for a blow out is achieved. The IVR allows rapid shut in of the wellbore annulus to minimize and prevent further influx into the well while the rig completes its well control procedures to close the BOP. This may enhance safety in land and offshore environments through a system and method by significantly reducing the influx volume, such that the influx can be safely managed and controlled at surface with the existing safety equipment without breaching wellbore and equipment safe operating limits. This may allow an operator to alter their designs with respect to casing setting depths given the kick tolerance because this system provides a heightened safety factor when in place.

The QCA 10 may be used as described above in all phases of the drilling operation until well completion-tripping, drilling, circulating, cementing, casing installations, connections, drill stem testing and logging. This system is particularly valuable during cementing, logging and casing operations, as the rig equipment and personnel are move vulnerable to an influx incident during these operations, when conventional BOP equipment will likely have an even more extensive time period to shut down the annulus.

This system may be installed in any land based drilling rig or offshore drilling installation including jack-ups, platforms, and barges having a blow out preventer (BOP) at the surface. The system will be positioned at, but not limited to, a position on top of any BOP and/or at any point in any riser configuration (e.g. for semi submersibles & drill ships referenced in UK patent application GB 1204310.5 (filed 12 Mar. 2012) and U.S. patent application Ser. No. 13/443,332 (filed 10 Apr. 2012). The possible location of the QCA 10 are illustrated in these of different types of systems are illustrated in FIGS. 6-10.

Referring now to FIGS. 6 and 7, these show how the QCA 10 may be used in a land-based drilling system comprising a well head 36 mounted in casing 42 at the top of a well bore, a derrick 44, a rotary table 46, and a surface area 48. In this example, the QCA 10 is installed directly above a conventional surface BOP stack mounted on the wellhead 36. In this example, the BOP stack comprises, running from the wellhead 36 upwards, a ram BOP 37, a spool 38, further ram BOPs 39, 40, and a conventional annular BOP 41. The QCA 10 can, however, be installed on any configuration of surface BOP stack. For example, it is also envisioned that the conventional annular BOP 41 could be completely replaced by a further QCA 10 with the appropriate pressure rating for that service.

These figures demonstrate the limited degree of vertical space available above the BOP stack to position the QCA 10 in land based operations, which may impose some restrictions on the options for its installation.

FIG. 8 illustrates how the QCA may be used in a shallow water jack-up drilling rig. "Shallow" water is generally defined as less than 400 foot in depth. In this case, the QCA 10 is installed directly or indirectly atop a conventional BOP stack 52 at surface 50 above the water line 51. The jack-up rig has the same or similar operationally required components to the land-based system, namely the wellhead 36, casing 42, derrick 44, rotary table 46, and surface area 48. This figure also shows a diverter bell nipple/bell nipple 54 mounted above the QCA 10. In this rig type, as the BOP stack 52 is mounted directly below the rig floor deck on a riser which extends up from the wellhead on the ocean floor, there is limited vertical space available in the riser above the BOP stack 52 for the installation of the QCA 10 in shallow water fixed drilling platforms.

FIG. 9 illustrates how the QCA 10 may be installed in a deepwater off-shore drilling rig. In this case, the QCA 10 is mounted in a riser 30 which extends from a subsea BOP stack 52 to surface.

Persons skilled in the art will fully understand the distinct differences with regards to deep water drilling operations in comparison to shallow water or land based drilling. For the purpose of this application, the significant difference will be that the BOP's are installed on the ocean floor for deep water drilling operations versus at surface as per shallow water and land based drilling. It is further realized that subsea BOP's are not considered conventional drilling equipment compared to their predecessors, which do not have to function below the water line in submersed environments. Common components found in all drilling operations, however possibly having varying capabilities, complexities or positioning, are illustrated FIG. 9 and include the wellhead 36, casing 42, derrick 44, rotary table 46 and surface area 50, along with the BOP stack 52. FIG. 9 also shows the water line 51, as in the fixed installation shallow water drilling rig illustrated in FIG. 8 which is, of course, not present in the land based drilling rig illustrated in FIG. 6. In contrast to the shallow water and land based drilling systems previously described, it should be noted that, in deepwater drilling, there is a large of vertical space available in the riser for the installation of the IVR system above the subsea BOP stack 52.

Aspects of this deep water drilling system, including the control system for the QCA 10 described above in relation to FIG. 2 above are illustrated in more detail in FIG. 10. It will be appreciated, of course, that this control system will also be provided in relation to the QCA 10 when used in the land based and shallow water drilling systems described above in relation to FIGS. 6 and 8.

FIG. 10 shows a diverter assembly 25 for diverting uncontrolled gas and drilling mud from the riser annulus; an upper flex joint 26 for allowing tilting motion between a rig and a riser, and a self-tensioning slip joint 27 for compensating vertical motion between a subsea well and a floating drilling rig. The QCA 10 is located below the slip joint 27 and above a flowspool assembly 29. The QCA 10 and flow spool assembly 29 are considered as part of the riser string 30 and deployed through the rig's rotary system in the same manner—this is possible given the maximum outer diameter of the QCA 10 of 46.5 inches. The QCA 10 will normally be situated just beneath the water line and splash zone.

In this example, the accumulators 23 (in this example there are more than two of them) are mounted on the riser at the base of the flowspool assembly 29. The accumulators 23 are positioned such that the length of the close line 21*b* between the accumulators 23 and the close chamber 17*b* does not exceed around 15 ft.

The open line 21*a* and close line 21*b* comprise large (at least 2 inch diameter) rigid conduit lines that run from the hydraulic BOP control system (not shown) mounted on the rig floor parallel to the flowspool body 29. The close line 21*b* comprises large (at least 2 inch diameter) rigid conduit lines that run parallel to the flowspool body to the close chambers of the BOP to assure fast actuation. The open line can be 2" in diameter as well, but need not be, particularly if it is also provided with a quick dump valve to release fluid from the open chamber to atmosphere, rather than return it to reservoir via the control system 6.

As discussed above the QCA 10 may also safely route entrapped gas from the riser 30 to a riser gas handling or choke manifold, where it the gas can be circulated out in a controller manner. Diverter assemblies 25 are not designed to close in on a riser and on many deepwater drilling rigs, they are rated to very low working pressure (500 psi) which is insufficient for riser kill operation. The QCA 10 has several advantages over the diverter packer 32; that the slip joint packer seals 33 are not exposed to increased pressure for any extended time, that it closes faster than the diverter packer 32, that it is has a higher pressure rating than diverter assembly 25 and slip joint packer seals 33. Isolating these components above it allows back pressure to be applied by a choke or back pressure valve on a choke manifold without exceeding the lower pressure capacities of these components.

In the prior art, the diverter 25 situated above the slip joint 27 is used as a safety system to re-route entrapped gas in the wellbore fluid away from the rig. The gas travels up the riser, via the slip joint and is diverted overboard. This arrangement requires the slip joint packers to seal against the wellbore pressure which may led to catastrophic failure of packer elements and loss of containment and pollution if oil based drilling fluids are used. Since under normal drilling situation, the slip joint packers 33 are energized to seal against the hydrostatic pressure of the wellbore fluid between the slip joint packer 33 and the diverter 25 which is minimal. It is not designed to seal against wellbore pressure and typically some seepage is allowed to lubricate the slip joint 27.

When the actuator of the QCA 10 moves to close the sealing element around a drill pipe, it acts as a blowout preventer and protects the low pressure diverter system above it. Moreover, provision of the inventive BOP 10 beneath the slip joint 27 negates this necessity of the slip joint packers 33 to seal against wellbore pressure.

The system will be compatible with, but not limited to, any pressure containment device currently used. These will include, but are not limited to, RCD, RDD, RBOP, and PCWD technologies.

FIG. 11 illustrates how the QCA 10 may be coupled with cross overs/spool adapters and flow spool/flow cross for ease of installation atop a conventional BOP or any other connectors or devices normally connected atop the BOP. These devices may be referred to in the industry as Diverter Bell Nipples or simply Bell Nipples.

This shows flow spool 62 having flanged connections on its top and bottom. While the top flange will be adjoined to the lower studded connection of the QCA 10, the bottom connection is manufactured for compatibility with any connection type atop the BOP 52 and thus will vary among drilling rig installations. The flow spool is also provided with two outlet flanges 63*a*, 63*b* which each extend around a side port provided in the flow spool 62 and allow for the connection of the pressure relief lines 64*a*, 64*b* and pressure relief valves 65*a*, 65*b* as described in relation to FIGS. 3 and 4.

In the example illustrated in FIG. 11, a cross over or spool adapter 86 is also provided, thus enabling the QCA 10 to be connected to devices normally connected atop the conventional BOP 52. A bottom flange 86*b* of the cross over or spool adapter 86 is adjoined to the upper studded connection of the QCA 10, whilst an upper flange connection 86*a* is manufactured to allow for the connection to the specific interface type of the device normally connected atop the BOP 52.

It will be appreciated, of course, that the cross over/spool adapter 86 may be integral with the first housing part 11 of the QCA 10. Alternatively or additionally, the flow spool 62 may be integral with the second housing part 12.

The QCA 10 may be incorporated in a closure device of the kind described in our co-pending patent applications WO2011/128690 and WO2012/127180, namely the QCA 10 being one of a plurality of closure devices included in one combined system. In the example illustrated in FIG. 12, a further annular BOP 88 is mounted above the QCA 10, with the lower housing of the further annular BOP 88 being integrated with the first housing part 11 of the QCA 11. The further BOP 88 may be actuated to close the annulus during a well control event in addition to the QCA 10. The flow spool 62 in this example has a 4 1/16" 5K outlet 63*b* with the addition of a 7 1/16" 5K outlet 63*a* allowing for fluid diversion to the rigs fluids & solids control equipment or diversion to managed pressure drilling surface control equipment.

The QCA may also be used in conjunction with a seal sleeve assembly such as that described in our co-pending patent applications WO2011/128690, WO2012/127180, and WO2012/127227, for example, in managed pressure drilling (MPD) operations. These applications show a stack of three BOPs, with a seal sleeve assembly mounted in the upper two BOPs. The seal sleeve assembly allows the upper two BOPs to be operated to contain fluid pressure in the annulus during rotation of the drill string and or while stripping under pressure. The lowermost BOP in the stack may be a QCA 10 and may be closed, when the seal sleeve assembly is worn out, to maintain pressure in the annulus whilst the seal sleeve assembly is removed and replaced, or in the event that any of the seals provided by the seal sleeve assembly and upper two BOPs leak, fail or malfunction. The QCA 10 is not designed to withstand the forces created by rotation of the drill string, however, and therefore should only be closed once drill pipe rotation has ceased.

Alternatively, the QCA 10 may be used as illustrated in FIG. 13*a* as the lowermost pressure containment device in a two BOP stack. The seal sleeve 90 (illustrated in isolation in FIG. 13*b* and in situ in FIG. 13*a*) may be inserted into both the QCA 10 and upper BOP 88 during drilling. In this case, either or both the upper BOP 88 and QCA 10 may be closed around the drill string to contain fluid pressure in the annulus during managed pressure drilling. In this embodiment, however, it will be necessary to use the rig's subsea BOP system to isolate the riser while removing or installing the seal sleeve from the BOP stack. Moreover, the presence of the seal sleeve will impact on the ability of the QCA 10 to close rapidly as described above, and, in this case, the QCA 10 can be used for a rapid shut in of the well bore when the seal sleeve is not in position.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of drilling a subterranean well bore comprising, monitoring the well bore for influx of formation fluid into the well bore, and, on detection of an influx:

a) stopping any pump pumping fluid into the well bore;

b) operating a first blow out preventer so that it closes within a first period of time;

c) operating a second blow out preventer so that it closes within a second period of time, the second blow out preventer being located below the first blow out preventer, the second period of time being longer than the first period of time; and d) circulating the influx out of the well bore via a flow line extending from below the second blow out preventer.

2. The method according to claim 1 wherein the second blow out preventer is capable of containing fluid at a higher pressure than the first blow out preventer.

3. The method according to claim 1 wherein there is a flow spool provided between the first blow out preventer and second blow out preventer with a fluid flow line hereinafter referred to as a pressure relief line extending from the flow spool, the pressure relief line containing a pressure relief valve which is normally closed so as to substantially prevent flow of fluid along the pressure relief line, and the method further includes the step of, after the closing of the first blow out preventer, opening the pressure relief valve to allow flow of fluid along the pressure relief line if the fluid pressure in the flow spool exceeds a predetermined level.

4. The method according to claim 3 wherein the flow spool is provided with a second fluid flow line hereinafter referred to as a second pressure relief line extending from the flow spool, the second pressure relief line containing a second pressure relief valve which is normally closed so as to substantially prevent flow of fluid along the second pressure relief line, and the method further includes the step of, after the closing of the first blow out preventer, opening the second pressure relief valve to allow flow of fluid along the second pressure relief line if the fluid pressure in the flow spool exceeds a second predetermined level.

5. The method according to claim 3 wherein the pressure relief line extends from the flow spool to a mud gas separator.

6. The method according to claim 4 wherein the second pressure relief line extends from the flow spool to an overboard diversion point.

7. An apparatus for use in drilling a subterranean well bore comprising:

a first blow out preventer;

a second blow out preventer, the second blow out preventer being located below the first blow out preventer and secured to a well head, wherein the first blow out preventer is operable to close within a first period of time, and the second blow out preventer is operable to close within a second period of time, the second period of time being longer than the first period of time;

a flow spool provided between the first blow out preventer and second blow out preventer with a fluid flow line hereinafter referred to as a pressure relief line extending from the flow spool, the pressure relief line containing a pressure relief valve which is normally closed so as to substantially prevent flow of fluid along the pressure relief line and which opens to allow flow of fluid along the pressure relief line if the fluid pressure in the flow spool exceeds a predetermined level; and a flow line extending from below the second blow out preventer, the flow line being configured to circulate the influx out of the well bore.

8. The apparatus according to claim 7 wherein the second blow out preventer is capable of containing fluid at a higher pressure than the first blow out preventer.

9. The apparatus according to claim 7 wherein the flow spool is provided with a second fluid flow line hereinafter referred to as a second pressure relief line extending from the flow spool, the second pressure relief line containing a second pressure relief valve which is normally closed so as to substantially prevent flow of fluid along the second pressure relief line and which opens to allow flow of fluid along the second pressure relief line if the fluid pressure in the flow spool exceeds a second predetermined level.

10. The apparatus according to claim 7 wherein the pressure relief line extends from the flow spool to a mud gas separator.

11. The apparatus according to claim 9 wherein the second pressure relief line extends from the flow spool to an overboard diversion point.

12. The apparatus according to claim 7 wherein first blow out preventer is mounted on a riser which extends upwardly from the second blow out preventer.

13. The apparatus according to claim 12 wherein the flow spool is mounted on an upper end of the riser between the blowout preventer and the riser.

14. The apparatus according to claim 12 wherein the riser includes a slip joint, and the first blowout preventer is mounted in the riser below the slip joint.

15. The apparatus according to claim 7 wherein the second blow out preventer is mounted on a riser which extends upwardly from the well head.

16. A method of drilling a subterranean well bore comprising, monitoring the well bore for influx of formation fluid into the well bore, and, on detection of an influx:

a) stopping any pump pumping fluid into the well bore;

b) operating a first blow out preventer so that it closes within a first period of time;

c) opening a pressure relief valve to allow a flow of fluid along the pressure relief line if a fluid pressure in a flow spool exceeds a predetermined level, the flow spool being provided between the first blow out preventer and second blow out preventer with the pressure relief line extending from the flow spool, the pressure relief line containing the pressure relief valve normally being closed so as to substantially prevent the flow of fluid along the pressure relief line;

d) operating a second blow out preventer so that it closes within a second period of time, the second blow out preventer being located below the first blow out preventer and being secured to a well head, the second period of time being longer than the first period of time; and e) circulating the influx out of the well bore via a flow line extending from below the second blow out preventer.

* * * * *